United States Patent [19]

Harasta et al.

[11] Patent Number: 4,477,548

[45] Date of Patent: Oct. 16, 1984

[54] RADIATION-CURABLE OVERCOAT COMPOSITIONS AND TONER-IMAGED ELEMENTS CONTAINING SAME

[75] Inventors: Louis P. Harasta, Rochester; Gerald M. Leszyk, Spencerport; Edward D. Morrison, Rochester, all of N.Y.

[73] Assignee: Eastman Kodak Company, Rochester, N.Y.

[21] Appl. No.: 562,043

[22] Filed: Dec. 16, 1983

Related U.S. Application Data

[63] Continuation of Ser. No. 414,128, Sep. 2, 1982, abandoned.

[51] Int. Cl.[3] ..... G03G 5/14; G03G 13/20

[52] U.S. Cl. ..... 430/14; 430/18; 430/124; 430/126; 430/132; 204/159.13; 430/532; 430/536; 430/961

[58] Field of Search ..... 430/14, 18, 48, 124, 430/126, 132; 204/159.13

[56] References Cited

U.S. PATENT DOCUMENTS

| | | |
|---|---|---|
| 2,901,349 | 8/1959 | Schaffert et al. . |
| 3,686,084 | 8/1972 | Rosenkranz et al. . |
| 3,861,911 | 1/1975 | Luebbe, Jr. . |
| 4,043,887 | 8/1977 | Pacifici et al. . |
| 4,078,948 | 3/1978 | Martellock . |
| 4,092,173 | 5/1978 | Novak et al. . |
| 4,130,708 | 12/1978 | Friedlander et al. . |
| 4,148,637 | 4/1979 | Kubota et al. . |
| 4,259,429 | 3/1981 | Gilliams et al. . |
| 4,301,226 | 11/1981 | Contois et al. . |
| 4,333,998 | 6/1982 | Leszyk . |

FOREIGN PATENT DOCUMENTS

| | | |
|---|---|---|
| 2924687 | of 0000 | Fed. Rep. of Germany . |
| 56-025749 | of 0000 | Japan . |
| 1458617 | of 0000 | United Kingdom . |

OTHER PUBLICATIONS

Rodenburg and Contois, *J. Appl. Photo. Eng.*, 5(4), 1979, pp. 244–248.

*Research Disclosure*, publication 10928, May, 1973, pp. 67–72.

*Research Disclosure*, publication 10938, May, 1973, pp. 61–67.

*Primary Examiner*—Roland E. Martin

*Attorney, Agent, or Firm*—Alfred P. Lorenzo

[57] ABSTRACT

Curable coating compositions useful for protective treatment of elements bearing electrographically-formed toner images are comprised of (a) either (i) a mixture of a siloxy-containing polycarbinol and an acrylated urethane, or (ii) a siloxy-containing acrylated urethane; (b) a multifunctional acrylate; and, optionally (c) a free radical photoinitiator. Toner image-bearing elements, such as electrographic elements and specifically photoconductive recording films, can be provided with a protective overcoat layer which is bonded to the element and which serves to protect the toner image from abrasion and scratches. Such an overcoat layer is provided by coating the element with a curable composition and curing the resulting coating. The protective overcoat layer is applied to the toner image-bearing side of the element.

34 Claims, 1 Drawing Figure

RADIATION-CURABLE OVERCOAT COMPOSITIONS AND TONER-IMAGED ELEMENTS CONTAINING SAME

This is a continuation of application Ser. No. 414,128, filed Sept. 2, 1982 now abandoned.

Field of the Invention

This invention relates in general to electrography and, in particular, to compositions useful for protective treatment of elements bearing electrographically-formed images. In one aspect, this invention relates to elements bearing electrographically-formed images, such as electrographic elements and specifically photoconductive recording films, having a protective overcoat provided by applying and curing a curable composition. In another aspect, this invention relates to radiation-curable coating compositions which can be used to provide such protective overcoat layers. In still another aspect, this invention relates to a method for providing such elements which are protected from abrasion and scratches.

Background of the Invention

Electrographic elements having protective overcoat layers are well known and a wide variety of different coating compositions have been proposed in the past for use as protective overcoats. Protective overcoats serve a number of different purposes, such as to provide protection against fingerprints, abrasion, scratching and other physical abuse, to provide extended wear life and protection from blocking, and to provide protection from chemical treatments which might deleteriously affect the imaging layer (e.g. cleaning operations).

Protective overcoats can be applied to certain electrographic elements, e.g. electrophotographic elements, by coating them with solutions or dispersions of film-forming acrylic resins in organic solvents such as are described, for example, in *Research Disclosure,* publication 10928, pages 67–72 (published May, 1973 by Industrial Opportunities, Ltd., Homewall, Havant Hampshire P09 1EF, United Kingdom) and U.S. Pat. No. 4,148,637 (issued Apr. 10, 1979 to Kubota et al).

Further, U.S. Pat. No. 3,861,911 (issued Jan. 21, 1975 to Luebbe, Jr.) relates to a method of fixing toner images on non-photographic-image areas of photographic films by applying one of a number of photopolymerizable compositions to the toned area only and irradiating the composition with actinic radiation. The toner images so fixed serve as titles for the films.

U.S. Pat. Nos. 4,092,173 (issued May 30, 1978 to Novak et al.); 4,171,979 (issued Oct. 23, 1979 to Novak et al.); and 4,333,998 (issued June 8, 1982 to Leszyk) describe a variety of radiation-curable compositions which have found use as protective overcoats and restorative compositions for various photographic elements. In the Novak et al patents, the radiation-curable compositions include an acrylated urethane, an aliphatic ethylenically-unsaturated carboxylic acid and a multifunctional acrylate. In the Leszyk patent, the compositions additionally include a siloxy-containing polycarbinol. In addition, U.S. Pat. No. 4,130,708 (issued December 1978 to Friedlander et al) relates to radiation-curable compositions containing the reaction product of a siloxy-containing polycarbinol, a polyisocyanate and a polyfunctional acrylate. Such compositions are described as useful for overcoating a variety of substrates including wood, metals, paper, glass, linoleum, tile and resins.

Many of the radiation-curable compositions used in the past to form protective overcoats on either electrophotographic or photographic elements have suffered from disadvantages which have greatly limited their usefulness. For example, it has been particularly difficult to formulate compositions which are fully satisfactory in providing abrasion and scratch resistance for specific elements having specific utilities. For example, overcoat compositions which may be suitable for elements having thereon toner images may not be suitable for elements containing photographic images. Useful compositions must not only have sufficient abrasion and scratch resistance, but must also meet other exacting requirements after coating and curing, such as transparency, flexibility, resistance to chemical treatments (e.g. cleaning) and must be capable of very strong adhesion to underlying layers to avoid delamination.

The protective overcoats described in the Novak et al and Leszyk patents noted hereinabove have sufficiently met these requirements for a number of photographic elements, such as microfiche and motion picture films. However, it has been found that they suffer from several disadvantages which limit their usefulness as protective overcoats for elements bearing electrographically-formed toner images, such as electrophotographic elements (including photoconductive recording films) useful for rapid-access instrumentation or aerial imaging. It has been observed that known protective overcoats exhibit an unacceptable level of haze (i.e. loss of transparency) on certain electrographic elements which are used to provide high resolution images. Such haze appears to increase both with age after curing and if the overcoat compositions have been stored a long time prior to use. Hence, there is a need for improved protective overcoats exhibiting improved transparency.

It has also been observed that known overcoat compositions sometimes tend to immediately solvate or dissolve certain polyester binders commonly used in toner particles which are used to provide toner images in electrographic elements. If this rapid solvating action occurs before the image is fixed, a loss in image detail invariably results. Where high resolution of images is important, such solvating action renders the element useless.

As an alternative to overcoating electrographic elements for abrasion- and scratch-resistance, some commercial users of such elements manually wrap them in specially-fabricated plastic sleeves or envelopes after image formation. Although this technique provides adequate protection for the element, it is considerably slow and tedious and necessitates high labor and material costs. It also requires considerable handling of the elements which increases the likelihood of image smudges and the need for element cleaning.

Therefore, there is a need in the art for a method of protecting electrographic elements without recourse to the slow and costly practice of wrapping them in sleeves. This protection may be provided by overcoating the elements. However, there is a need in the art for an improved coating composition useful for providing abrasion- and scratch-resistant protective overcoats having improved transparency for electrographic elements. It is also desirable that such a composition have extended shelf life and be relatively "inert" (i.e. no immediate solvating action) with respect to toner particles typically used to provide toned images in such elements.

Summary of the Invention

The present invention is directed to an improved method of protecting elements bearing an electrographically-formed toner image of toner particles from abrasion and scratches, which method obviates the need to wrap the elements in plastic sleeves. The present invention is also directed to a novel radiation-curable coating composition and its use as a protective overcoat when coated on such elements and cured, which overcoat layer is transparent and flexible and exhibits improved abrasion and scratch resistance. In addition, this coating composition has improved shelf life and is relatively "inert" with respect to the polymeric binders of particulate toners typically used to provide toner images in electrographic elements. This means that the novel coating composition of this invention has less tendency to dissolve or solvate the binder immediately after coating compared to known compositions. Hence, such elements can provide high resolution images in which image details are readily discerned.

Accordingly, this invention provides an element bearing an electrographically-formed image, which element comprises a substrate bearing an electrographically-formed toner image of toner particles, and an abrasion- and scratch-resistant, crosslinked polymeric overcoat bonded to the toner image-bearing substrate. The overcoat layer is formed by coating a curable coating composition onto the toner image-bearing substrate, and curing the resulting coating to bond it to the substrate. Such a curable coating composition comprises (a) either (i) a mixture of a siloxy-containing polycarbinol and an acrylated urethane or (ii) a siloxy-containing acrylated urethane, (b) a multifunctional acrylate, and, optionally, (c) a free radical photoinitiator.

Further, this invention provides a method of protecting an element bearing an electrographically-formed image of toner particles against abrasion and scratches. This method comprises coating the toner image with the curable coating composition described hereinabove; and curing the resulting coating to bond it to the element.

Further still, this invention provides a radiation-curable coating composition particularly useful in preparing the elements of this invention. Such a coating composition comprises (a) either (i) a mixture of a siloxy-containing polycarbinol and an acrylated urethane or (ii) a siloxy-containing acrylated urethane, (b) a multifunctional acrylate, and (c) a haloalkyl-substituted aryl ketone free radical photoinitiator.

Detailed Description of the Invention

Figure 1:
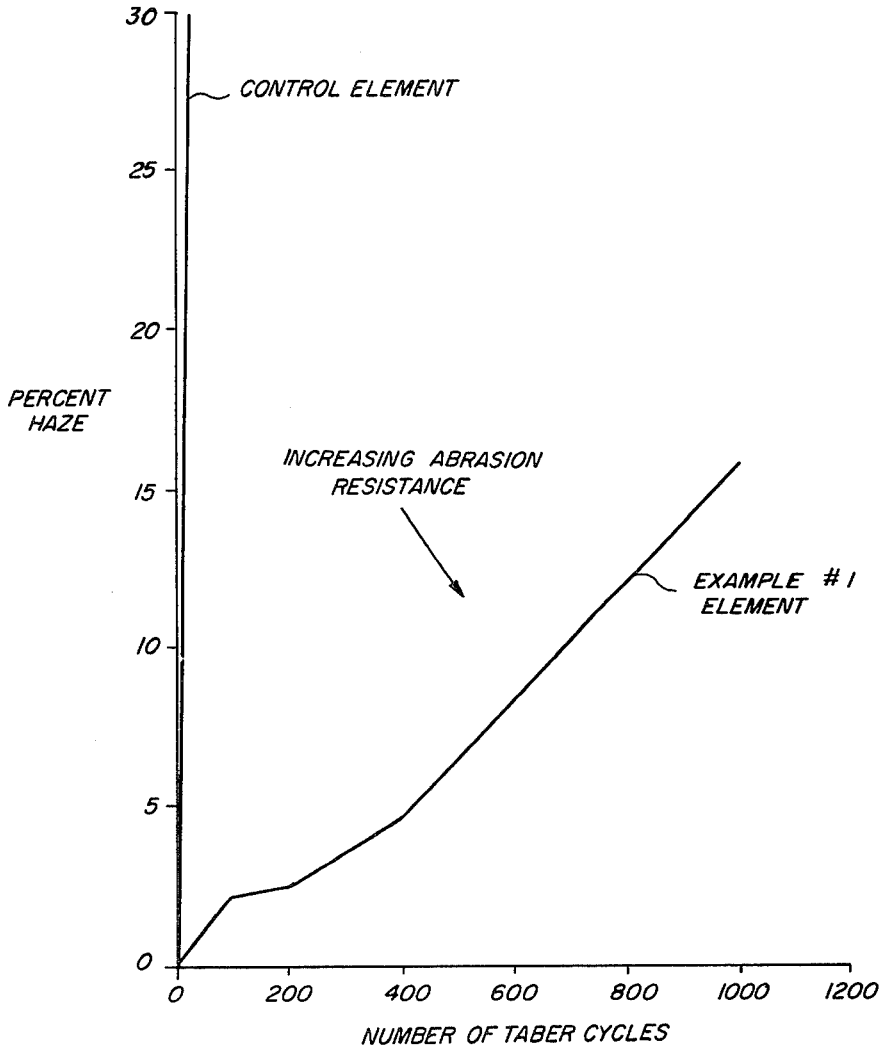
FIG. 1 is a graph plotting percent haze as a function of the number of Taber cycles for an electrophotographic element having a protective overcoat in accordance with this invention and an element without such an overcoat.

The elements of this invention are those capable of bearing an "electrographically-formed" image. As used throughout the specification and in the claims, this term is defined to mean images provided by forming a latent image with electrostatic charge on an electrically insulating surface and developing that image with toner particles.

The elements of this invention include what are known in the art as "single-use" elements upon which a toner image is directly formed by developing and fixing a single time on a single element (such as a photoconductive recording film). In other words, such elements are capable of both forming and bearing electrographic images. Such elements have one or more insulating imaging layers capable of holding an electrostatic charge pattern prior to image development.

Alternatively, the elements of this invention include what are known in the art as receiving elements which are capable of "receiving" and bearing either an already formed electrostatic charge pattern (i.e. latent image) or an already formed electrographic toner image. Such receiving elements are typically used in electrographic processes in conjunction with "reusable" electrographic elements which repeatedly form and transfer either the electrostatic charge pattern or the electrographic toner images to receiving elements (such as plain paper).

The curable coating compositions described herein can be used to provide protective overcoats in many different types of elements capable of bearing electrographically-formed images. As noted above, such elements include electrographic elements upon which such images are formed as well as receiving elements to which such images are transferred. Typical of image forming elements are electrophotographic elements, electrostatographic elements, photoconductive recording films and the like. Typical of image receiving elements are plain paper, dielectric recording films and the like. Curing of the compositions described herein, especially by irradiation with suitable radiation, has been found to provide strong bonding to all of these different types of elements without adversely affecting the element or image thereon. The details of certain elements within the scope of this invention, their preparaton and use are described in *Research Disclosure,* publications 10938 and 10928, both published May, 1973, pp. 61–67 and 67–72, respectively.

The elements of this invention typically comprise a suitable substrate which is capable of bearing a toner image provided by toner particles. Where the element "receives" an electrostatic charge or toner image, the substrate serves as the support as well as also bearing the toner image. Where the toner image is retained on the element on which it is formed, the substrate includes a support and one or more imaging layers capable of bearing a toner image. Preferably, the imaging layer is a photoconductive layer which generally comprises one or more photoconductive materials.

Any suitable support can be used in the elements of this invention. Examples of useful supports include cellulosic sheets (e.g. papers which can be uncoated or resin-coated); polymeric films prepared from cellulose esters, polyesters, polycarbonates, polyolefins, polyamides, etc., metallic sheets and foils; and ceramic materials. Supports preferred in the practice of this invention are electrically conductive supports. Examples of such preferred supports include conductive papers (i.e. papers treated to render them conductive), aluminum-paper laminates, metal foils (e.g. aluminum and zinc foils), metal plates (e.g. aluminum, zinc, brass and galvanized plates), and olymeric films (e.g. polyesters, polycarbonates, cellulose esters polystyrene, etc.) having vapor-deposited metal layers (e.g. silver, nickel and aluminum) thereon. An especially useful electrically conductive support is a transparent polymeric film having a conductive layer thereon. One example of such a support is prepared by coating a polyester, e.g. poly(ethylene terephthalate), with a layer containing a semiconductor dispersed in a resin. A suitable electrically conductive coating can also be prepared from the sodium salt of a carboxyester lactone of a maleic anhydride-vinyl acetate copolymer, cuprous iodide, conductive carbon or cermet (see U.S. Pat. No. 3,880,657 issued Apr. 29, 1975 to Rasch), or the like. Such conductive layers and methods for their preparation and use are disclosed in U.S. Pat. Nos. 3,007,901 (issued Nov. 7, 1961 to Minsk); 3,245,833 (issued Apr. 12, 1966 to Trevoy); and 3,267,807 (issued July 26, 1966 to Sterman), the disclosures of which are incorporated herein by reference, as well as in the *Research Disclosure* publications noted hereinabove.

The elements of this invention can comprise one or more imaging layers upon which a toner image can be formed. Generally, only one imaging layer is used. Any layer which is capable of holding an applied pattern or uniform blanket of electrostatic charge which can be selectively dissipated, if desired, is suitable in the practice of this invention. For example, the imaging layer can be a dielectric recording layer as described in U.S. Pat. No. 3,519,819 (issued July 7,1970 to Gramza et al). Preferably, such imaging layers are photoconductive layers which retain electrostatic charge in areas which are unexposed to electromagnetic radiation of a selected wavelength (e.g. visible or ultraviolet light).

Any of the photoconductive layers utilized in electrophotography can be used in a preferred embodiment of this invention. Typically, the photoconductive layer is a single layer containing one or more photoconductors, one or more binders and, optionally, various sensitizing addenda. Alternatively, the imaging layer has a multilayer configuration containing two or more separate photoconductor-containing layers, or one or more separate photoconductor-containing layers together with one or more separate layers containing sensitizing addenda. The photoconductors in such layers can be inorganic, organic (including polymeric, nonpolymeric or organometallic types), or mixtures of each type or any combination of two or more types. Useful inorganic photoconductors include zinc oxide, zinc sulfide, titanium dioxide, cadmium sulfide, cadmium selenide, lead oxide and the like. Useful organometallic photoconductors include derivatives of Group IIIa, IVa and Va metals having at least one aminoaryl group attached to the metal atom. Among the many useful organic photoconductors are those disclosed in Belgian Patent 748,511 (published June 15,1970); R. M. Schaffert's book *Electrophotography,* Focal/Hastings House, New York, 1975, Chapter 11 (pp 380–396) and references listed therein; U.S. Pat. Nos. 3,180,730 (issued Apr. 27, 1965 to Klupfel et al.); 3,240,597 (issued Mar. 15, 1966 to Fox); 3,274,000 (issued Sept. 20, 1966 to Noe et al.); 3,542,544 (issued Nov. 24, 1970 to Seus et al.); 3,542,547 (issued Nov. 24, 1970 to Wilson); 3,567,450 (issued Mar. 2, 1971 to Brantly et al.); and 3,820,959 (issued June 28, 1974 to Rule et al.); and *Research Disclosure,* publications 10938 and 10928 mentioned hereinabove; and other references too numerous to mention.

Photoconductors especially useful in the practice of this invention are the polyaryl methanes, the description and preparation of which are given in U.S. Pat. No. 4,301,226 (issued Nov. 17, 1981 to Contois et al.), the disclosure of which is incorporated herein by reference. A preferred embodiment of this invention utilizes a mixture of two or more, and more preferably at least three, of the organic photoconductors described in the Contois et al patent, including but not limited to a mixture of two or more of bis(N,N-dialkylamino-2-alkylaryl)-4-alkylarylmethanes; 1,1-bis(4-N,N-dialkylamino-2-alkylaryl)-2-alkylpropanes and 4,4'-bis(dialkyl-amino)-2,2'-dialkyltriarylmethanes.

The total amount of photoconductor included in the photoconductive layer can vary widely, but typically ranges from about 5 to 50 percent based on total dry layer weight. Preferably, the amount ranges from about 20 to about 40 percent.

A wide variety of materials are known to be useful as electrically insulating binders for the photoconductive materials, where desired. In some cases, the photoconductor material can act as a binder as well (e.g. certain polymeric photoconductors). Typically, however, a separate binder material is used. Preferred electrically insulating binders useful in preparing the photoconductive layers are film-forming, hydrophobic polymeric binders having fairly high dielectric strength. Such materials include styrene-butadiene copolymers; silicone resins; styrene-alkyd resins; silicone-alkyd resins; soya-alkyd resins; poly(vinyl chloride); poly(vinylidene chloride); vinylidene chloride-acrylonitrile copolymers; poly(vinyl acetate); vinyl acetate-vinyl chloride copolymers; poly(vinyl acetals), such as poly(vinyl butyral); polyacrylic and polymethacrylic esters, such as poly(methyl methacrylate), poly(n-butyl methacrylate), poly(isobutyl methacrylate), etc.; polystyrene; nitrated polystyrene; polymethylstyrene; isobutylene polymers; polyesters, such as poly[ethylene-co-alkylenebis-(alkyleneoxyaryl)-phenylenedicarboxylate]; phenolformaldehyde resins; ketones resins; polyamids; polycarbonates; polythiocarbonates; poly[ethylene-co-isopropylidene-2,2-bis(ethyleneoxyphenylene)terephthalate]; copolymers of vinyl haloarylates; poly(ethylene-co-neopentyl terephthalate); and vinyl acetate such as poly(vinyl-m-bromobenzoate-co-vinyl acetate); and the like. Poly[ethylene-co-isopropylidene-2,2-bis (ethyleneoxyphenylene)terephthalate] is a preferred binder.

Methods of making resins of these types have been described in the prior art. For example, polyester resins, such as the preferred polyester mentioned above, can be prepared according to known methods. Other types of binders which can be used in the photoconductive layers include such materials as paraffin, mineral waxes, wood resins, sucrose esters, gum arabic, and the like. In addition to polymerizates, materials which are polymerized or condensed in situ or undergo crosslinking can also be used, alone or in combination with polymerized materials. The binders can be used alone, or in mixtures of two or more in any proportions, in amounts which are known in the art.

The photoconductive layers of the elements of this invention can also be spectrally and/or chemically sensitized by the addition of effective amounts of sensitizing compounds. Sensitizing compounds useful with the photoconductive compounds can be selected from a wide variety of materials, including such materials as pyrylium dye salts including thiapyrylium dye salts and selenapyrylium dye salts disclosed in U.S. Pat. No. 3,250,615 (issued May 10, 1966 to VanAllen et al.); fluorenes; aggregate-type sensitizers of the type described in U.S. Pat. No. 3,615,414 (issued Oct. 26, 1971 to Light); aromatic nitro compounds of the kind described in U.S. Pat. No. 2,610,120 (issued Sept. 9, 1952 to Minsk et al.); anthrones like those disclosed in U.S.

Pat. No. 2,670,284 (issued Feb. 23, 1954 to Zranut); quinones, U.S. Pat. No. 2,670,286 (issued Feb. 23, 1954 to Minsk et al.); benzophenones, U.S. Pat. No. 2,670,287 (issued Feb. 23, 1954 to Minsk et al.); thiazoles, U.S. Pat. No. 2,732,301 (issued Jan. 24, 1956 to Robertson et al.); mineral acids; carboxylic acids such as maleic acid, di- and trichloroacetic acids, and salicylic acid; sulfonic and phosphoric acids; and various dyes, such as cyanine (including carbocyanine), merocyanine, diarylmethane, thiazine, azine, oxazine, xanthrene, phthalein, acridine, azo, anthraquinone dyes and the like and mixtures thereof. The sensitizers preferred for us in the practice of this invention are selected from pyrylium salts including selenapyrylium salts and thiapyrylium salts, and cyanine dyes including carbocyanine dyes such as disclosed in U.S. Pat. No. 3,597,196 (issued Aug. 3, 1971 to Jones).

Where a sensitizing compound is employed with the binder and photoconductor to form a photoconductive layer, it can be mixed with the coating composition in any suitable method. The amount of sensitizer that can be added to the photoconductor layer to give effective increases in speed can vary widely. The optimum concentration in any given case will vary with the specific photoconductors and sensitizing compound used. In general, substantial speed gains can be obtained where an appropriate sensitizer is added in a concentration range from about 0.0001 to about 30 percent based on the total dry weight of the photoconductive layer. Normally, a sensitizer is added in an amount of from about 0.005 to about 5.0 percent by weight.

A variety of solvents are useful for preparing photoconductive or other image-bearing layer coating compositions useful in the present invention. For example, aromatics, such as benzene and toluene; ketones, such as acetone and 2-butanone; chlorinated hydrocarbons such as methylene chloride, ethylene chloride, and the like; ethers, such as tetrahydrofuran and the like; or mixtures of such solvents can advantageously be employed in the practice of this invention.

Coating thicknesses of the photoconductive or other image-bearing layer on a support can vary widely. Normally, a wet coating thickness in the range of about 0.025 mm to about 2.5 mm is useful in the practice of the invention. A preferred range of coating thickness is from about 0.050 mm to about 0.15 mm before drying although such thicknesses can vary widely depending on the particular application desired for the particular element.

To promote the adhesion between contiguous layers of an element of this invention, it may be desirable to use one or more subbing layers in the element. Such layers may also be known as interlayers. For example, a subbing layer can be provided between layers of an electrically conductive support, such as between a film of poly(ethylene terephthalate), and a conductive coating, such as a layer of evaporated nickel or a semiconductor. Alterantively, a subbing layer can be provided between the support and the image-bearing layer. Subbing layers (or interlayers) can also be used between contiguous image-bearing layers or between contiguous image-bearing layers and sensitizing layers. Particularly useful subbing layers are composed of interpolymers of vinylidene chloride, such as poly(vinylidene chloride-co-acrylonitrile-co-acrylic acid) or poly(vinylidene chloride-co-methyl acrylate-co-itaconic acid), but other known subbing materials can be used as well. Subbing layers can also be used to provide optical or electrical barriers as well as to provide adhesion between contiguous layers.

The elements of this invention can be prepared by combining the above-described layers and materials using well known techniques. For example, the image-bearing layers can be applied to supports in any suitable manner including conventional coating techniques, such as spray, swirl, dip, extrusion hopper, air knife, bead and curtain coating procedures.

The first essential ingredient of the curable coating compositions useful in the elements of this invention is either (i) a mixture of a siloxy-containing polycarbinol and an acrylated urethane, or (ii) a siloxy-containing acrylated urethane. Preferably, the siloxy-containing acrylated urethane is used in the coating composition. This preferred compound can be characterized as a compound having a siloxy-group-containing backbone on which at least one urethane moiety is formed at a reactive carbinal group position, which urethane moiety has at least one terminal ethylenic group typically provided by an acrylic functional group. The useful siloxy-containing acrylated urethane can be monomeric or oligomeric in character. For example, it could comprise a single siloxane group having one urethane moiety to which an acrylate group is attached. Alternatively, a polysiloxane can have one or more urethane moieties attached to several carbinol groups, each urethane moiety having one or more acrylate groups. The siloxy-containing acrylated urethane can be obtained by known methods, described, for example, in U.S. Pat. No. 4,130,708 (issued Dec. 19, 1978 to Friedlander et al), the disclosure of which is incorporated herein by reference.

The siloxy-containing acrylated urethane is typically prepared by reacting together one or more siloxy-containing polycarbinols, one or more polyisocyanates and one or more acrylate compounds having at least one functional group which is reactive with an isocyanate group of the polyisocyanate, which acrylate compound provides at least one ethylenic functional group (e.g. acrylic group) in the reaction product.

Any suitable siloxy-containing polycarbinol can be used in the practice of this invention, including those described in the Friedlander et al patent and in U.S. Pat. No. 4,333,998 (issued June 8, 1982 to Leszyk). These polycarbinols can be used in admixture with the acrylated urethanes described hereinbelow, or reacted with the isocyanates and acrylate compounds as described below to form the siloxy-containing acrylated urethane. Siloxy-containing polycarbinols are also known as organofunctional silicones having carbinol functionality. As used throughout this specification and in the claims, the term "siloxy-containing" is defined as any compound having at least one silicon-oxygen group which may be substituted as described hereinbelow. The term is thus intended to include compounds having one or more siloxane groups, i.e. a group having alternating silicon and oxygen atoms, such as an

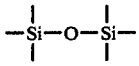

group. Mixtures of polycarbinols are also useful.

Siloxy-containing polycarbinols which are particularly useful in the practice of this invention can be represented by the formula (I):

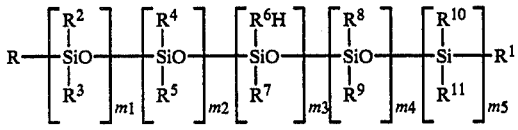

wherein R, $R^1$, $R^2$, $R^3$, $R^4$, $R^5$, $R^7$, $R^8$, $R^9$, $R^{10}$ and $R^{11}$ are independently alkyl,

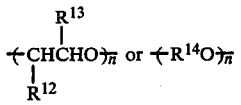

$R^{12}$ and $R^{13}$ are independently hydrogen, halo, alkyl or aryl, $R^{14}$ is alkylene, and n is an integer of from 1 to 100; $R^6$ is

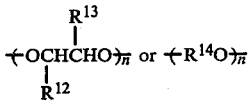

wherein $R^{12}$, $R^{13}$, and $R^{14}$ and n are as defined above; $m_1$ is an integer of from 1 to 100; $m_2$ is an integer of from 0 to 100; $m_3$ is an integer of from 0 to 4; $m_4$ is an integer of from 0 to 100; and $m_5$ is 0 or 1, provided that when $m_3$ is 0, at least two of R, $R^1$, $R^2$, $R^3$, $R^4$, $R^5$, $R^7$, $R^8$, $R^9$, $R^{10}$ and $R^{11}$ are

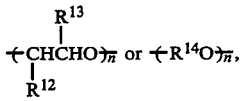

and when $m_3$ is 1, at least one of R, $R^1$, $R^2$, $R^3$, $R^4$, $R^5$, $R^7$, $R^8$, $R^9$, $R^{10}$ and $R^{11}$ is

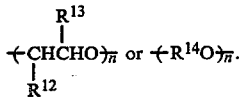

Where any of R, $R^1$, $R^2$, $R^3$, $R^4$, $R^5$, $R^7$, $R^8$, $R^9$, $R^{10}$ or $R^{11}$ is alkyl, it is preferably an unsubstituted or substituted, linear or branched alkyl of 1 to 6 carbon atoms where the substitutents can be halo (e.g. fluoro, chloro, bromo, iodo), amino, alkoxy (of from 1 to 20 carbon atoms), aryloxy (of from 6 to 20 carbon atoms), arylalkoxy (of from 7 to 30 carbon atoms), cycloalkyl (of from 5 to 20 carbon atoms,), aryl (of from 6 to 20 carbon atoms) and the like as known to one skilled in the art. Preferably, R, $R^1$, $R^2$, $R^3$, $R^4$, $R^5$, $R^7$, $R^8$, $R^9$, $R^{10}$ and $R^{11}$ are independently alkyl of from 1 to 3 carbon atoms, and most preferably, each is methyl. Any of the enumerated R groups can also be a bivalent oxyalkylene group which with hydrogen attached to the oxygen atom of the group and the carbyl portion of the group attached to the silicon atom provides a reactive carbinol, such as

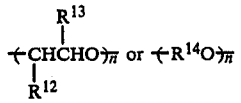

wherein $R^{12}$ and $R^{13}$ is independently hydrogen, halo (as defined above), alkyl (preferably of from 1 to 6 carbon atoms as defined above) or aryl (preferably of from 6 to 20 carbon atoms, e.g. phenyl, xylyl, naphthyl, mesityl, 4-chlorophenyl, etc.); and $R^{14}$ is alkylene (preferably of from 1 to 12 carbon atoms, e.g. methylene, ethylene, 1,1-isopropylene, neopentylene, etc.). Preferably, $R^{12}$ and $R^{13}$ are independently alkyl, and more preferabky alkyl of from 1 to 3 carbon atoms; preferably $R^{14}$ is alkylene of from 2 to 6 carbon atoms, and more preferably, tetramethylene. The integer n is preferably from 1 to 25.

Also in formula (I), preferably, each of $m_1$ and $m_5$ is 1; $m_2$ is an integer from 1 to 100; and $m_4$ is 0. More preferably, $m_3$ is also an integer from 2 to 4.

In a selection of a particular combination of the above-specified radicals and integers defining a preferred polycarbinol, such polycarbinol must contain at least two hydroxyl groups per molecule. These hydroxyl groups can be terminally positioned or positioned along the siloxane backbone. More preferred polycarbinol compounds have an average of two or three hydroxyl groups per molecule and average molecular weights in the range of from about 800 to 6000. Specific subclasses and specie of useful polycarbinols are described in the Friedlander et al patent mentioned hereinabove. Commercially available polycarbinols include Dow Corning TM products 193 Surfactant, 1248 Fluid, XF4-3557 Fluid, Q4-3667 Fluid, and Q2-8026 Fluid, all of which are available from Dow Corning Corporation, Midland, Mich.

It is to be understood that formula (I) is intended to be schematic in character, and that the siloxy blocks can be randomly dispersed along the backbone.

The siloxy-containing acrylated urethane useful in the practice of this invention can be prepared from any suitable polyisocyanate or mixture of such. Such compounds have at least two isocyanate groups. Useful polyisocyanates include ethylene diisocyanate, 1,2-diisocyanatopropane, 1,3-diisocyanaatopropane, 1,6-diisocyanatohexane, 1,2-diisocyanatocyclohexane, 1,3-diisocyanatocyclohexane, 1,4-diisocyanatocyclohexane, o-diisocyanatobenzene, m-diisocyanatobenzene, p-diisocyanatobenzene, bis(4-isocyanatocyclohexyl)methane, bis(4-isocyanatophenyl)methane, toluene diisocyanate, 3,3'-dichloro-4,4'-diisocyanatobiphenyl, tris(4-isocyanatophenyl)-methane, 1,5-diisocyanatonaphthalene, hydrogenated toluene diisocyanate, 1-isocyanatomethyl-5-isocyanaato-1,3,3-trimethylcyclohexane, and 1,2,5-tris(6-isocyanatohexyl)biuret. Also useful are polyisocyanates in a blocked form such as phenyl-blocked toluene diisocyanate and phenyl-blocked diisocyanatonaphthalene.

The third compound necessary for making the siloxy-containing acrylated urethane useful in the practice of this invention is an acrylate compound having at least one functional group reactive with the polyisocyanate and at least one acrylic or methacrylic group which is available after the acrylate has reacted with the polyisocyanate. Preferably, the group reactive with the polyisocyanate is a hydroxyl group, and the acrylate compound is a hydroxyl-containing acrylic ester. Useful esters include 2-hydroxyethyl acrylate, 2-hydroxypropyl acrylate, 3-hydroxypropyl acrylate 3-hydroxypropyl methacrylate, 2-hydroxyethyl methacrylate, 2-hydroxypropyl methacrylate, 3-hydroxybutyl acrylate, 1-methyl-2-hydroxyethyl methacrylate and the like.

Any suitable acrylated urethane or mixtures of such can be used in the practice of this invention as long as each is readily crosslinked by heat or suitable radiation. The acrylated urethanes can be monomers, oligomers or polymers or mixtures thereof. Such materials are well known and typical acrylated urethane materials are described, for example, in U.S. Pat. Nos. 3,509,234 (issued Apr. 28, 1970 to Burlant et al.); 3,694,415 (issued Sept. 26, 1972 to Honda et al.); 3,719,638 (issued Mar. 6, 1973 to Huemmer et al.); 3,775,377 (issued Nov. 27, 1973 to Kokawa); 4,092,173 (issued May 30, 1978 to Novak et al.) and 4,227,980 (issued Oct. 14, 1980 to Pregitzer et al.); and in U. K. Patent Specification No. 1,321,372 (published June 27, 1973).

In one embodiment of this invention, acrylated urethane oligomers are used, such oligomers being represented by the formula (II):

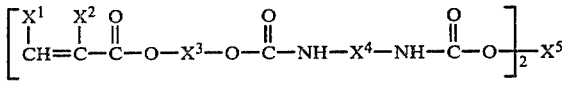

wherein $X^1$ and $X^2$ are independently hydrogen; halo (such as fluro, chloro or bromo); or alkyl (preferably of 1 to 3 carbon atoms, e.g. methyl, ethyl, isopropyl, etc.). Preferably, each of $X^1$ and $X^2$ is hydrogen.

$X^3$ and $X^4$ are independently alkylene typically of from 1 to 8 carbon atoms, such as methylene, ethylene, 2,2-dimethylpropylene, 2-chloropropylene, pentylene, hexylene, etc.; cycloalkylene typically of from 5 to 10 carbon atoms, such as cyclopentylene, cyclohexylene, 1,4-cyclohexylenedimethylene, etc.; or arylene typically of from 6 to 12 carbon atoms, such as phenylene, naphthylene, xylylene, tolylene, etc. Preferably, $X^3$ is alkylene and $X^4$ is arylene. More preferably, $X^4$ is phenylene.

$X^5$ is a divalent aliphatic, alicyclic or aromatic radical of at least 2 carbon atoms, and includes hydrogen and carbon atoms, and optionally, oxygen atoms. Such aliphatic, alicyclic and aromatic radicals include alkylene, cycloalkylene, arylene, alkenylene, alkynylene, alkylenearylene, alkylenecycloalkylene, alkylenebisarylene, cycloalkylenebisalkylene, arylenebisalkylene, alkylene-oxy-alkylene, alkylene-oxy-arylene-oxyalkylene, arylene-oxy-alkylene, alkylene-oxycycloalkylene-oxy-alkylene etc. In addition, such radicals include those derived from polyesters with water molecules split off the ends. Preferably, $X^5$ is alkylene, cycloalkylene or arylene as defined hereinabove for $X^3$ and $X^4$, except having up to 20 carbon atoms. More preferably, $X^5$ is alkylene of from 1 to 8 carbon atoms.

The acrylated urethanes can be prepared using known methods, the details of which are given in the above-mentioned references. In general, an acrylated urethane is prepared by reaction of a diisocyanate with a diol followed by reaction with an unsaturated alcohol. More specifically, acrylated urethane oligomers can be prepared by reacting a hydroxy-substituted acrylate of the formula

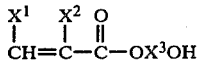

with a diisocyanate of the formula

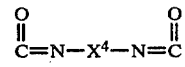

and a diol of the formula HO-$X^5$-OH wherein $X^1$, $X^2$, $X^3$, $X^4$ and $X^5$ are as defined above. Alternatively, a polyester can be reacted in place of the diol. Such reactants and conditions of reaction are well known to one skilled in the polymer chemistry art.

A preferred acrylated urethane oligomer has the formula:

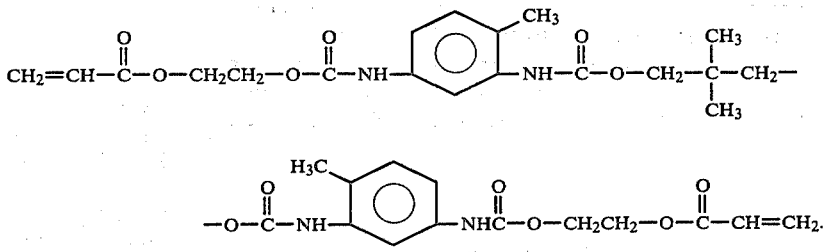

Another useful acrylated urethane is Celrad TM CMD-6700, commercially available from Celanese Corporation, New York, N. Y.

A second essential component of the curable coating compositions useful in the practice of this invention is a multifunctional acrylate, i.e. an acrylic monomer comprising at least two acrylic ester groups. Mixtures of such multifunctional acrylates can be used if desired in order to provide optimum coating and curing properties.

In one embodiment of this invention, useful multifunctional acrylates have the formula (III):

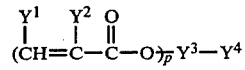

wherein p is an integer of from 1 to 3 and preferably 2 or 3. $Y^1$ and $Y^2$ are independently hydrogen; halo, e.g. fluoro, chloro or bromo; or alkyl of from 1 to 3 carbon atoms. Preferably $Y^1$ and $Y^2$ are independently methyl or hydrogen. $Y^3$ is a polyvalent aliphatic, alicyclic or aromatic group as described for $X^5$ hereinabove except that $Y^3$ can have up to 4 valences (divalent, trivalent or tetravalent). Preferably $Y^3$ is alkylene as defined for $X^3$ and $X^4$. $Y^4$ is hydrogen or

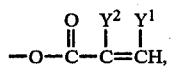

provided that when p is 1, $Y^4$ is the latter group. Preferably $Y^4$ is hydrogen.

Examples of useful acrylic monomers include neopentylglycol diacrylate, pentaerythritol triacrylate, 1,6-hexanediol diacrylate, trimethylolpropane triacrylate, tetraethylene glycol diacrylate, 1,3-butylene glycol diacrylate, trimethylolpropane trimethacrylate, 1,3-butylene glycol dimethacrylate, ethylene glycol dimethacrylate, pentaerythritol tetraacrylate, tetraethylene glycol dimethacrylate, 1,6-hexanediol dimethacrylate, ethylene glycol diacrylate, diethylene glycol diacrylate, glycerol diacrylate, glycerol triacrylate, 1,3-propanediol diacrylate, 1,3-propanediol dimethacrylate, 1,2,4-butanetriol trimethacrylate, 1,4-cyclohexanediol diacrylate, 1,4-cyclohexanediol dimethacrylate, pentaerythritol diacrylate and 1,5-pentanediol dimethacrylate. An especially useful multifunctional acrylate is trimethylolpropane triacrylate.

Preferably, a mixture of multifunctional acrylates are used in order to obtain desired coating viscosity, cure time, and hardness. For example, a preferred mixture includes one or more diacrylates and one or more triacrylates.

An optional, but preferred, component of the curable coating compositions described herein is a free radical photoinitiator. Such coating compositions are radiation-curable. Two or more of such photoinitiators can be used if desired. A wide variety of free radical photoinitiators can be used in the practice of this invention as long as they do not deleteriously affect the desired properties of the resulting crosslinked protective overcoat (e.g. hardness, abrasion-resistance, adhesion, etc.) while providing a sufficient cure rate. Photoinitiators are not necessary when curing is carried out with high energy electrons. Examples of useful free radical photoinitiators include alkyl benzoin ethers, such as benzoin ether; benzil; benzoin; benzophenone; benzophenone with an amine (e.g. triethylamine), such as methyldiethanol amine; dimethyl quinoxiline; 4,4'-bis(dimethylamino)-benzophenone; acetophenones, such as 2,2-diethoxyacetophenone and t-butyl-α-trichloroacetophenone; and the like.

A class of particularly useful free radical photoinitiators are defined as haloalkyl-substituted aryl ketone compounds. Generally, such compounds contain one or more aryl (e.g. phenyl or naphthyl) groups and one or more substituent ketone and haloalkyl groups. One specific class of such photoinitiators is described in U.S. Pat. No. 3,988,228 (issued Oct. 26, 1976 to Newland et al.).

Preferably, the photoinitiators useful in the practice of this invention are haloalkylbenzophenones, for example, which can be represented by the formula (IV):

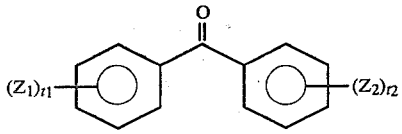

wherein $T_1$ and $t_2$ are independently integers from 0 to 5 provided that the sum of $t_1$ and $t_2$ is at least 1. More preferably, $t_1$ and $t_2$ are independently 1 or 2 and most preferably, each is 1.

Also in formula (IV), $Z_1$ and $Z_2$ are independently halo (e.g. fluoro, chloro, bromo or iodo); alkoxycarbonyl (preferably having from 2 to 10 carbon atoms, e.g. methoxycarbonyl, propoxycarbonyl, t-butoxycarbonyl, etc.); alkyl (preferably having from 1 to 10 carbon atoms, e.g. methyl, ethyl, isopropyl, sec-butyl, hexyl, etc.); or haloalkyl (preferably having from 1 to 10 carbon atoms and one or more halo atoms, e.g. fluoromethyl, chloromethyl, bromomethyl, dichloromethyl, tribromomethyl, chlorobromomethyl, 1,1-dichloroethyl, 2,2,4,4-tetrabromohexyl, iodomethyl, etc.), provided that at least one of $Z_1$ and $Z_2$ is haloalkyl. More preferably, in formula (IV), $Z_1$ and $Z_2$ are independently alkyl or haloalkyl. Most preferably, each is haloalkyl.

Useful photoinitiators include such compounds as 3,4-bis(chloromethyl)benzophenone; 3,4-bis(chloromethyl)-4'-carbomethoxybenzophenone; 3,4-bis(chloromethyl)-4'-chlorobenzophenone; 3,4-bis(bromomethyl)-benzophenone; 3,4-bis(dichloromethyl)benzophenone; 4,4'-bis(chloromethyl)benzophenone; 4,4'-bis(trichloromethyl)benzophenone; 4,4'-bis(dichloromonobromomethyl)benzophenone, 3,3-bis(1-chloroethyl)-benzophenone; and others described, for example, in U.S. Pat. Nos. 3,686,084 (issued Aug. 22, 1972 to Rosenkranz et al.) and 4,043,887 (issued Aug. 23, 1977 to Pacifici et al.), the disclosures of which are incorporated herein by reference. One preferred photoinitiator is 4,4'-bis(chloromethyl)benzophenone.

The photoinitiators useful in the practice of this invention are either readily available commerically or readily prepared using known techniques, such as are described in the Rosenkranz et al., Newland et al. and Pacifici et al. patents noted hereinabove.

When the curable coating compositions useful in the practice of this invention are to be cured with heat, one or more thermal initiators can be included in the compositions. Examples of thermal initiators are organic peroxides, such as isobutyl peroxide, di(2-ethylhexyl)-peroxydicarbonate, acetyl cyclohexane sulfonyl peroxide, 2,4-dichlorobenzoyl peroxide, lauroyl peroxide, t-butyl peroxyoctoate, 2,5-dimethyl-2,5-bis(benzoylperoxy)hexane, t-butyl peroxyacetate, etc.; and azo compounds, such as 2,2'-azobis-(isovaleronitrile), 2-t-butylazo-2-cyano-4-methoxy-4-methylpentane, 2,2'-azobis-(isobutyronitrile), 2-cyano-4-methylpentane, 2-t-butylazo-2-cyanobutane; 1-t-amylazo-1-cyanocyclohexane, etc. When used, such thermal initiators are present in the curable coating compositions typically in an amount of from about 0.5 to about 8, and preferably from 2 to about 4 percent, based on total composition weight.

The proportions of each of the two essential components and of the optional photoinitiator or thermal initiator in the curable coating compositions can be varied widely, as desired. Typically, where a mixture of siloxy-containing polycarbinol and acrylated urethane is used, the siloxy-containing polycarbinol is present in an amount of from about 0.5 to about 10 percent, and preferably from about 1 to about 4 percent, based on total composition weight; and the acrylated urethane is present in an amount of from about 4 to about 80 percent, and preferably from about 20 to about 40 percent, based on total composition weight. When a siloxy-containing acrylated urethane is used in the composition, it is typically present in an amount of from about 5 to about 80, and preferably of from about 20 to about 40 percent, based on total composition weight. Also, generally, the multifunctional acrylate is present in the composition in an amount of from about 20 to about 95 percent, and preferably from about 40 to about 80 percent, based on total composition weight. The free radical photoinitiator or thermal initiator is present typically in an amount of from about 0.1 to about 15 percent, and preferably from about 2 to about 8 percent, based on total composition weight. The optimum amounts to use in a particular instance will depend upon the particular compounds involved, the use of the coating composition and upon the characteristics of the element which is being overcoated and can be routinely determined.

A particularly useful radiation-curable coating composition includes a siloxy-containing acrylated urethane, trimethylolpropane triacrylate, 1,6-hexanediol diacrylate and 4,4'-bis(chloromethyl)benzophenone.

Other optional ingredients can be added to the coating composition as desired, such as matting agents, viscosity modifiers (e.g. organic solvents or monofunctional acrylate), adhesion promoters (e.g. acrylamide or organosilanes), slip agents and other addenda known to be useful in overcoat compositions.

The overcoat compositions of this invention are used to provide protection from abrasion and scratches for a variety of elements. It is particularly useful on electrographic elements used in electrographic processes. In a typical electrographic process, an electrographically-formed toner image is provided on an electrographic element by first giving the imaging layer of the element a positive or negative imagewise pattern electrostatic charge (i.e. a latent image) as desired in a suitable manner. The charge pattern can be then developed on the element to form a toner image with a suitable developer composition comprising electrostatically responsive particles usually having optical density. The developer composition is in the form of an optional carrier plus toner particles, e.g. a liquid dispersion, dust or powder. The toner particles typically comprise a colorant(e.g. a pigment) in a polymeric binder.

Alternatively, the latent image on the electrographic element can be transferred to a second element, e.g. a receiving element, which has a receiving substrate where the latent image is then developed with a developer composition. The overcoat compositions of this invention can then be used to protect the toner image on the receiving element. Still another alternative would be to transfer a developed toner image from the electrographic element to a second element, e.g. a receiving element, and subsequently overcoat with the curable compositions described herein.

For a preferred embodiment of this invention, the overcoat compositions are applied to electrophotographic elements useful in an electrophotographic process. In such a process, a photoconductive layer of an electrophotographic element is given a blanket positive or negative electrostatic charge in a suitable manner, e.g. by placing the element under a corona discharge apparatus to give a uniform charge to the surface of the photoconductive layer. This charge is retained on the insulating photoconductive layer until it is selectively dissipated by imagewise exposure to electromagnetic radiation of suitable wavelength (e.g. visible or ultraviolet light) by means of a conventional exposure technique to form a latent electrostatic image on the photoconductive layer. The latent image is then developed with a suitable developer composition to provide an unfixed toner image. The unfixed toner image is then fixed by overcoating the photoconductive layer as described hereinbelow. Optionally, the toner image can be fixed by conventional means prior to overcoating.

A variety of developer compositions are available for use in developing electrostatic charge patterns (or electrostatic latent images). Some are known as dry developer compositions, while others are known as liquid developer compositions. Among the more common dry developer compositions are aerosol (i.e. powder cloud) developers, cascade developers, magnetic brush developers, fur brush developers and others known in the art as described, for example, in Research Disclosure, publication 10938, May, 1973.

In a preferred embodiment of this invention, a toned image is formed on an electrographic element by developing an electrostatic latent image with a liquid developer composition which comprises a particulate toner in an electrically insulating organic liquid carrier. Typical liquid developer compositions and their properties are well known and described in detail, for example, in U.S. Pat. Nos. 2,899,335 (issued Aug. 11, 1955 to Straughan); 3,788,995 (issued Jan. 29, 1974 to Stahly et al.); 4,052,325 (issued Oct. 4, 1977 to Santilli); and in Research Disclosure, publication 10938 noted hereinabove.

Particularly useful liquid developer compositions useful in the process of this invention are those described in U.S. Pat. No. 4,202,785 (issued May 13, 1980 to Merrill et al.), the disclosure of which is incorporated herein by reference. Such liquid developer compositions typically comprise a dispersion of a polyester, such as a polyesterionomer of a specific class, in a suitable carrier liquid. Suitable carrier liquids should be electrically insulating, have a fairly low dielectric constant and be physically inert with respect to the toner particles. As used throughout this specification and in the claims, the term "physically inert" is defined to mean that the toner particles are not swellable, softenable or solubilized by the carrier liquid. Such developer compositions can also include other addenda, such as waxes or plasticizers.

Useful carrier liquids have a dielectric constant of less than about 3, and a volume resistivity greater than about $10^{10}$ ohm/cm. Suitable carrier liquids include halogenated hydrocarbon solvents, for example, fluorinated lower alkanes, such as trichloromonofluoromethane, trichlorotrifluoroethane, etc., having a boiling range typically from about 2° C. to about 55° C. Other hydrocarbon solvents are useful, such as isoparaffinic hydrocarbons having a boiling point in the range of from about 145° to about 185° C., such as Isopar G (a trademark of the Exxon Corporation, Houston, Tex.) or cyclohydrocarbons, such as cyclohexane. Additional carrier liquids which may be useful in certain situations include polysiloxanes, odorless mineral spirits, octane and the like.

The polyesterionomer binders particularly useful in the practice of this invention are described in detail in the Merrill et al. patent noted hereinabove. Generally, they are characterized as having moieties derived from dicarboxylic acids containing a disulfonamido group. Such acids typically can be represented by the formula (V):

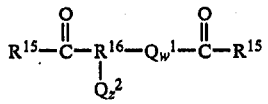

wherein w and z are 0 or 1 and whose sum is 1; $R^{15}$ is hydroxyl, halo (e.g. fluoro, chloro, bromo, iodo), alkoxy (preferably of from 1 to 10 carbon atoms, e.g., methoxy, ethoxy, isopropoxy, etc.) or an oxy linkage;

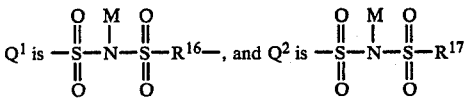

wherein $R^{16}$ is arylene (preferably of 6 to 20 carbon atoms, e.g. phenylene, naphthylene, xylylene, etc.), $R^{17}$ is alkyl (preferably of from 1 to 12 carbon atoms, e.g. methyl, isopropyl, n-hexyl, octyl, t-butyl, etc.) or an aromatic group (preferably of from 6 to 20 carbon atoms, e.g. phenyl, ethylenephenyl, xylyl, naphthyl, etc.), and M is a monovalent cation such as hydrogen, an alkali metal or an ammonium cation.

A preferred polyesterionomer binder is poly[2,2-dimethyl-1,3-propylene 4-methyl-4-cyclohexene-1,2-dicarboxylate-co-terephthalate-co-5-(N-sodio-p-toluenesulfonamidosulfonyl)isophthalate] (53/43/4).

Although it is possible to use a liquid developer composition without further addenda such as charge control agents or colorants, it is often desirable to incorporate such addenda into the developer composition.

If a colorless image is desired, it is unnecessary to add any colorant. When visible images are desirable, colorants are used in the liqud developer compositions. Useful results may be obtained from virtually any of a wide variety of known dyes or pigment materials. Particularly good results are obtained by using various kinds of carbon black pigments. A representative list of colorants may be found, for example, in *Research Disclosure,* publication 10938 noted hereinabove.

Optionally, the developers can also include various change control agents to enhance a uniform charge polarity on the developer toner particles. Various charge control agents have been described heretofore in the liquid developer art. Examples of such charge control agents may be found in U.S. Pat. No. 3,788,995 (issued Jan. 29, 1974 to Stahly et al.) which describes various polymeric charge control agents. various non-polymeric charge control agents may also be employed such as, for example, those described in U.S. Pat. No. 3,417,019 (issued Dec. 17, 1968 to Beyer).

The useful ratios of colorant to binder in typical toner particles and suitable amounts of charge control agent, if any, are well known in the art. Optimum amounts can be readily determined with routine experimentation.

The toned image on an element of this invention can be "fixed" (i.e. permanently adhered), if desired, either to the receiving substrate of a receiving element or to the imaging layer of an electrographic element prior to overcoating the toner image with the curable coating composition described herein. Any suitable fixing means can be used, including heat, pressure, solvent vapor or the like. Typically, heat is used to fix the toner particles. Preferably, however, the curable coating composition is applied to an unfixed toner image on an element. In this way, curing the coating composition fixes the toned image, thereby obviating any conventional fixing step. This results in manufacturing efficiencies and energy savings.

The curable coating composition can be applied to the fixed or unfixed toner image in any convenient manner. For example, it can be applied by dip coating, air-knife coating, roll coating, gravure coating, extrusion coating, curtain coating, bead coating, use of wire coating rods, etc. Typically, the coating deposited on the element will be a very thin coating having a wet coverage in the range from about 2 to about 20 cubic centimeters of coating composition per square meter of surface coated, but more usually in the range from about 3 to about 10 cubic centimeters of coating composition per square meter, and preferably about 5 cubic centimeters of coating composition per square meter. The viscosity of the coating composition can vary widely, depending on the particular method of coating which is chosen. Typically, satisfactory coatings can be readily formed on the elements from coating compositions having a viscosity in the range from about 25 to about 1000 centipoises, and more preferably in the range from about 75 to about 200 centipoises.

Apparatus and methods for curing the curable coating compositions described herein with heat or by subjecting them to suitable forms of radiation are well known, and any suitble heat or radiation curing process can be used in carrying out this invention. Preferably, curing is carried out by subjecting the overcoat coating to irradiation, such as to ultraviolet radiation of suitable intensity from medium pressure mercury arc lamps or other sources of ultrasonic radiation. High energy ionizing radiation such as X-rays, gamma rays, beta rays and accelerated electrons can also be used to accomplish curing of the coating. Typically, the radiation used should be of a sufficient intensity to penetrate substantially all the way through the coated layer. The total dosage employed should be sufficient to bring about curing of the radiation-curble coating composition to form a solid plastic. Typically, dosages in the range of about 0.2 to about 50 megarads, more usually in the range from about 0.5 to about 20 megarads, are employed.

Curing can also be accomplished by heating the coating composition, either alone or in conjunction with radiation curing. Typically, curing with heat is carried out at a temperature in the range of from about 50° to about 200° C., and preferably from about 70° to about 90° C. Depending upon the temperature used, curing time is usually greater than 5 seconds, and preferably ranges from about 5 to about 60 minutes.

The coating compositions of this invention are substantially completely convertible to a solid product so that the removal of solvent or diluents during the curing step is not necessary. Furthermore, they undergo little or no shrinkage upon curing. While it is not necessary to employ solvents or diluents which are removed from the coating in the curing step, they can be employed if needed to modify the properties of the coating composition.

The invention is further illustrated by the following examples of its practice.

EXAMPLE 1

This is a comparative example comparing an electrophotographic element of this invention, having the abrasion- and scratch-resistance provided by a protective overcoat derived from a radiation-curable coating composition described herein, to an element without such an overcoat.

A radiation-curable coating composition of this invention was prepared having the following components:

| | Weight Percent |
|---|---|
| a siloxy-containing acrylated urethane* | 19.8 |
| trimethylolpropane triacrylate | 47.6 |
| 1,6-hexanediol diacrylate | 25.1 |
| 4,4'-bis(chloromethyl)benzophenone | 7.5 |
| | 100.0 |

*This compound was Chempol TM 19-4842, commercially available from Freeman Chemical Co., Detroit, Michigan.

An electrophotographic element was prepared having a transparent, electrically conductive support and a photoconductive imaging layer similar to that described in Example 1 of U.S. Pat. No. 4,310,226 (issued Nov. 17, 1981 to Contois et al.). A uniform electrostatic charge was applied to two identical samples of this element and a latent image was formed on each by imagewise dissipating the electrostatic charge. A liquid developer composition containing toner particles in Isopar G TM carrier was used to develop the latent image to a visible image on each element sample. The toner particles contained a black colorant in a polyesterionomer binder.

The radiation-curable coating composition described above was coated with a reverse offset gravure coater over the toned image onto the unfixed toned photoconductive layer of one element sample (Example 1). The composition was then cured by passing the sampple under a bank of 118 watt/cm. high intensity mercury vapor UV lamps at a distance of 6.4 centimeters and a speed of 30.5 meters/min. A second sample (Control) was subjected to a heat fixing step to fuse the toner image, but was not overcoated with the radiation-curable coating composition.

Both element samples were subjected to scratch resistance and coefficient of friction tests in accordance with procedures of the American National Standards Institute, Inc., 1430 Broadway, New York, N. Y., USA 10018. Specifically, the scratch resistance tests were carried out in accordance with ANSI Test Method PH1.37-1977 and the coefficient of friction tests were carried out in accordance with ANSI Test Method PH1.47-1972.

Results obtained from these tests are reported in Table I below. With regard to the light transmission data, higher values for light transmission are indicative of less haze under the test conditions and of greater scratch resistance. With regard to the data for the "single arm scratch" test, values reported are the load in grams required to form a scratch which is visible at the indicated projection distance at 21° C. and 50% relative humidity, with higher values at a given projection distance being indicative of greater scratch resistance. The term "plow" refers to conditions under which the stylus of the test instrument "plows" its way through substantially the entire layer.

TABLE I

| | | Single Arm Scratch (grams) | | | |
|---|---|---|---|---|---|
| | Light Transmission | Projected at 1.2 meters | Projected at 4.6 meters | Plow | Coefficient of Friction |
| Control | 20 | 20 | 20 | 90 | .32 |
| Example 1 | 30 | 100 | 110 | 125 | .10 |

In addition both samples were subjected to a Taber cycle abrasion resistance test according to the A.S.T.M. D1044 test method of the American Society for Testing and Materials located in Philadelphia, Pa. The results of this test for both samples are illustrated in FIG. 1. For a given sample and level of haze, the greater the number of Taber cycles needed to reach that level of haze, the greater the abrasion resistance.

It can be seen from the results shown in Table I and FIG. 1 that the abrasion- and scratch-resistance of the overcoated element is significantly greater than that of the nonovercoated Control element.

Example 2

This example describes an additional radiation-curable coating composition useful for overcoating an electrophotographic element. The composition was prepared having the following components:

| | | Weight Percent |
|---|---|---|
| a siloxy-containing acrylated urethane* | | 30.6 |
| trimethylolpropane triacrylate | | 30.6 |
| diethyleneglycol diacrylate | | 30.6 |
| benzophenone | photoinitiator system | 4.1 |
| methyldiethanolamine | photoinitiator system | 4.1 |
| | | 100.0 |

*Same compound as used in Example 1.

This radiation-curable coating composition was applied to a sample of an electrophotographic element having an unfixed toned image like that described in Example 1. After curing with ultraviolet light, the resulting overcoat provided excellent abrasion- and scratch-resistance for the element. However, it exhibited more haze than the overcoat prepared in Example 1. This increased haziness is believed to be due to the particular photoinitiator system used.

Examples 3 and 4

These examples describe additional radiation-curable coating compositions of this invention. These compositions were coated over electrographically-formed toner images and provided results similar to the coating composition described in Example 1. The compositions were prepared having the following components:

| Example 3 | Weight Percent |
|---|---|
| a siloxy-containing acrylated urethane* | 23.9 |
| trimethylolpropane triacrylate | 43.4 |
| diethylene glycol diacrylate | 25.2 |
| 4,4'-bis(chloromethyl)benzophenone | 7.5 |
| | 100.0 |

*Same compound as used in Example 1.

| Example 4 | Weight Percent |
|---|---|
| an acrylated urethane** | 23.7 |
| a siloxy-containing polycarbinol*** | 0.7 |
| trimethylolpropane triacrylate | 43.1 |
| 1,6-hexanediol diacrylate | 25.0 |
| 4,4'-bis(chloromethyl)benzophenone | 7.5 |
| | 100.0 |

**Celrad TM CMD-6700, available from Celanese Corporation, New York, N.Y.
***Dow Corning TM Q4-3667 Fluid, available from Dow Corning Corp., Midland, Michigan.

The invention has been described in detail with particular reference to preferred embodiments thereof, but it will be understood that variations and modifications can be effected within the spirit and scope of the invention.

We claim:

1. An element bearing an electrographically formed image, said element comprising:

(A) a substrate bearing an electrographically-formed toner image of toner particles, and (B) an abrasion- and scratch-resistant, crosslinked polymeric overcoat layer bonded to said toner image-bearing substrate, said overcoat layer having been formed by:

(1) coating said toner image-bearing sustrate with a curable coating composition consisting essentially of (a) either (i) a mixture of a siloxy-containing polycarbinol and an acrylated urethane or (ii) a siloxy-containing acrylated urethane, and (b) a multifunctional acrylate of the formula:

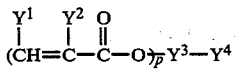

wherein p is an integer from 1 to 3; $Y^1$ and $Y^2$ are independently hydrogen, halo or alkyl; $Y^3$ is a polyvalent aliphatic, alicyclic or aromatic group; and $Y^4$ is hydrogen or

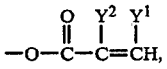

provided that when p is 1, $Y^4$ is

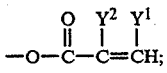

and (2) curing said coating to bond it to said toner image-bearing substrate.

2. The element of claim 1 which is an electrographic element comprising a support and superposed thereon a toner image-bearing layer.

3. The element of claim 2 which is an electrophotographic element and in which said toner image-bearing layer is a photoconductive layer.

4. The element of claim 1 wherein said toner particles comprise a colorant in a polymeric binder.

5. The element of claim 4 wherein said substrate is transparent.

6. The element of claim 1 wherein said siloxy-containing polycarbinol is represented by the formula (I):

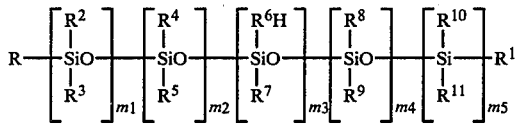

wherein R, $R^1$, $R^2$, $R^3$, $R^4$, $R^5$, $R^7$, $R^8$, $R^9$, $R^{10}$ and $R^{11}$ are independently alkyl,

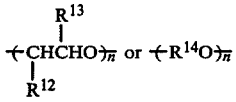

$R^{12}$ and $R^{13}$ are independently hydrogen, halo, alkyl or aryl, $R^{14}$ is alkylene, and n is an integer of from 1 to 100; $R^6$ is

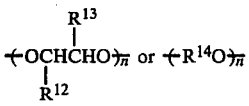

where $R^{12}$, $R^{13}$, $R^{14}$ and n are as defined above; $m_1$ is an integer of from 1 to 100; $m_2$ is an integer of from 0 to 100; $m_3$ is an integer of from 0 to 4; $m_4$ is an integer of from 0 to 100; and $m_5$ is 0 or 1, provided that when $m_3$ is 0, at least two of said R, $R^1$, $R^2$, $R^3$, $R^4$, $R^5$, $R^7$, $R^8$, $R^9$, $R^{10}$ and $R^{11}$ are

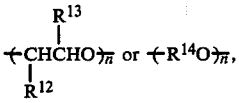

and when $m_3$ is 1, at least one of said R, $R^1$, $R^2$, $R^3$, $R^4$, $R^5$, $R^7$, $R^8$, $R^9$, $R^{10}$ and $R^{11}$ is

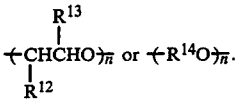

7. The element of claim 6 wherein each of $R^2$, $R^3$, $R^4$, $R^5$, $R^7$, $R^8$, $R^9$, $R^{10}$, and $R^{11}$ is methyl; each of $m_1$ and $m_5$ is 1; $m_2$ is 1 to 100; $m_4$ is 0; $R^{12}$ and $R^{13}$ are independently alkyl; and $R^{14}$ is alkylene of from 2 to 6 carbon atoms.

8. The element of claim 7 wherein each of R and $R^1$ is methyl; $m_3$ is 2 to 4; and n is 1 to 25.

9. The element of claim 1 wherein said acrylated urethane is represented by the formula (II):

wherein $X^1$ and $X^2$ are independently hydrogen, halo or alkyl; $X^3$ and $X^4$ are independently alkylene, cycloalkylene or arylene; and $X^5$ is a divalent aliphatic, alicyclic or aromatic radical.

10. The element of claim 9 wherein each of $X^1$ and $X^2$ is hydrogen; $X^3$ is alkylene; $X^4$ arylene; and $X^5$ is alkylene, cycloalkylene or arylene.

11. The element of claim 10 wherein $X^4$ is phenylene and $X^5$ is alkylene.

12. The element of claim 11 wherein said acrylated urethane has the formula:

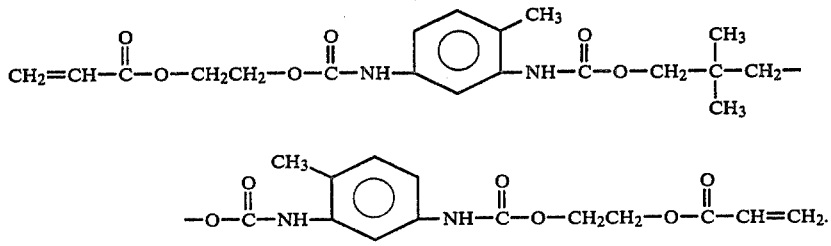

13. The element of claim 1 wherein said curable coating composition comprises said siloxy-containing acrylated urethane.

14. The element of claim 1 wherein said siloxy-containing acrylated urethane is the reaction product of a siloxy-containing polycarbinol, a polyisocyanate, and an acrylate polycarbinol, a least one functional group reactive with said polyisocyanate and at least one acrylic group.

15. The element of claim 14 wherein said acrylate compound is a hydroxyl-containing acrylic ester.

16. The element of claim 1 wherein p is 2 or 3; $Y^1$ and $Y^2$ are independently hydrogen or methyl; and $Y^3$ is alkylene.

17. The element of claim 1 wherein said curable coating composition comprises a mixture of a diacrylate and a triacrylate.

18. The element of claim 1 wherein said curable coating composition comprises a free radical photoinitiator.

19. The element of claim 18 wherein said free radical photoinitiator is a haloalkyl-substituted aryl ketone compound.

20. The element of claim 19 wherein said photoinitiator is a haloalkylbenzophenone.

21. The element of claim 20 wherein said haloalkylbenzophenone is represented by the formula (IV):

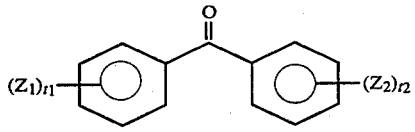

wherein $t_1$ and $t_2$ are independently integers from 0 to 5 provided that the sum of $t_1$ and $t_2$ is at least 1; and $Z_1$ and $Z_2$ are independently halo, alkoxycarbonyl, alkyl or haloalkyl, provided that at least one of $Z_1$ and $Z_2$ is haloalkyl.

22. The element of claim 21 wherein $t_1$ and $t_2$ are independently 1 or 2; and $Z_1$ and $Z_2$ are independently alkyl or haloalkyl.

23. The element of claim 22 wherein each of $t_1$ and $t_2$ is 1; and each of $Z_1$ and $Z_2$ is haloalkyl.

24. An electrophotographic element comprising:

(A) a transparent electrically conductive support, (B) a photoconductive layer superposed on said support and comprising a photoconductor dispersed in a binder, said layer bearing a toner image of toner particles comprising a colorant and a thermoplastic resin binder, and (C) an abrasion- and scratch-resistant, crosslinked polymeric overcoat bonded to said toned photoconductive layer, said overcoat having been formed by:

(1) coating said toned photoconductive layer with a curable coating composition consisting essentially of (a) either (i) a mixture of siloxy-containing polycarbinol and an acrylated urethane; or (ii) a siloxy-containing acrylated urethane; (b) a multifunctional acrylate of the formula:

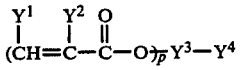

wherein p is an integer from 1 to b 3; $Y^1$ and $Y^2$ are independently hydrogen, halo or alkyl; $Y^3$ is a polyvalent aliphatic, alicyclic or aromatic group; and $Y^4$ is hydrogen or

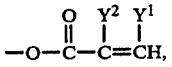

provided that when p is 1, $Y^4$ is

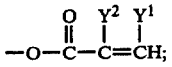

and (c) a free radical photoinitiator; and (2) curing said coating to bond it to said toned photoconductive layer.

25. The element of claim 24 wherein said curable coating composition comprises (a) a siloxy-containing acrylated urethane, (b) a mixture of trimethylolpropane triacrylate and 1,6-hexanediol diacrylate, and (c) 4,4'-bis(chloromethyl)benzophenone.

26. A method of protecting an element bearing an electrographically-formed toner image of toner particles against abrasion and scratches, said method comprising:

(1) coating said toner image with a curable coating composition which forms an abrasion- and scratch-resistant, crosslinked polymeric layer upon curing, said coating composition consisting essentially of (a) either (i) a mixture of siloxy-containing polycarbinol and an acrylated urethane or (ii) a siloxy-containing acrylated urethane, and (b) a multifunctional acrylate of the formula:

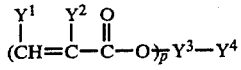

wherein p is an integer from 1 to 3; $Y^1$ and $Y^2$ are independently hydrogen, halo or alkyl; $Y^3$ is a polyvalent aliphatic, alicyclic or aromatic group; and $Y^4$ is hydrogen or

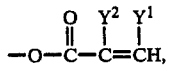

provided that when p is 1, $Y^4$ is

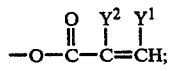

and (2) curing said coating to bond it to said element.

27. The method of claim 26 wherein said curable coating is subjected to radiation sufficient to cure said coating.

28. The method of claim 27 wherein said curable coating composition comprises a free radical photoinitiator, and said curing step (2) is accomplished with ultraviolet light.

29. The method of claim 26 wherein said toner image is fixed prior to said coating step (1).

30. The method of claim 29 wherein said toner fixing is accomplished with heat.

31. A method of providing an element bearing an electrographically-formed toner image of toner particles which is protected against abrasion and scratches, said method comprising:

(1) electrographically forming a toner image on a first element comprising a support having thereon an imaging layer with toner particles;

(2) transferring said toner image to a second element comprising a receiving substrate;

(3) coating said toner image-bearing substrate with a curable coating composition which forms an abrasion- and scratch-resistant crosslinked polymeric layer upon curing, said coating composition consisting essentially of (a) either (i) a mixture of a siloxy-containing polycarbinol and an acrylated urethane or (ii) a siloxy-containing acrylated urethane, and (b) a multifunctional acrylate of the formula:

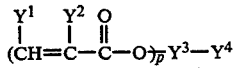

wherein p is an integer from 1 to 3; $Y^1$ and $Y^2$ are independently hydrogen, halo or alkyl; $Y^3$ is a polyvalent aliphatic, alicyclic or aromatic group; and $Y^4$ is hydrogen or

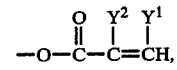

provided that when p is 1, $Y^4$ is

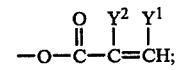

and (4) curing said coating to bond it to said toner image-bearing substrate.

32. A method of providing an element bearing an electrographically-formed toner image of toner particles which is protected against abrasion and scratches, said method comprising:

(1) forming an electrostatic latent image on a first element comprising a support having thereon an imaging layer;

(2) transferring said latent image to a second element comprising a receiving substrate;

(3) forming a toner image on said receiving substrate;

(4) coating said toner image-bearing substrate with a curable coating composition which forms an abrasion- and scratch-resistant, crosslinked polymeric layer upon curing, said coating composition consisting essentially of (a) either (i) a mixture of a siloxy-containing polycarbinol and an acrylated urethane or (ii) a siloxy-containing acrylated urethane, and (b) a multifunctional acrylate of the formula:

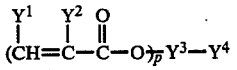

wherein p is an integer from 1 to 3; $Y^1$ and $Y^2$ are independently hydrogen, halo or alkyl; $Y^3$ is a polyvalent aliphatic, alicyclic or aromatic group; and $Y^4$ is hydrogen or

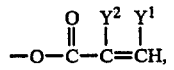

provided that when p is 1, $Y^4$ is

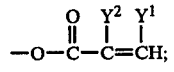

and (5) curing said coating to bond it to said toner image-bearingsubstrate.

33. A method of protecting an element bearing an electrographically-formed, unfixed toner image of toner particles which is protected against abrasion and scratches, said method comprising:

(1) fixing said unfixed toner image by coating it with a curable coating composition which forms an abrasion- and scratch-resistant, crosslinked polymeric layer upon curing, said coating composition consisting essentially of (a) either (i) a mixture of a siloxy-containing polycarbinol and an acrylated urethane or (ii) a siloxy-containing acrylated urethane, and (b) a multifunctional acrylate of the formula:

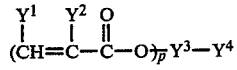

wherein p is an integer from 1 to 3; $Y^1$ and $Y^2$ are independently hydrogen, halo or alkyl; $Y^3$ is a polyvalent aliphatic, alicyclic or aromatic group; and $Y^4$ is hydrogen or

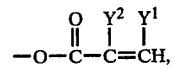

provided that when p is 1, $Y^4$ is $$-O-\overset{\overset{\displaystyle O}{\|}}{C}-\overset{\overset{\displaystyle Y^2}{|}}{C}=\overset{\overset{\displaystyle Y^1}{|}}{C}H;$$

and (2) curing said coating to bond it to said element.

34. A method of providing an electrophotographic film having a toner image of toner particles which is protected against abrasion and scratches, said film comprising a transparent electrically conductive support and a photoconductive layer superposed thereon, said method comprising:

(1) applying a blanket electrostatic charge to said photoconductive layer;

(2) forming a latent image on said photoconductive layer by selectively dissipating said electrostatic charge;

(3) forming an unfixed toner image on said photoconductive layer by applying a developer composition comprising toner particles;

(4) fixing said unfixed toner image by coating said photoconductive layer with a radiation-curable coating composition which forms an abrasion- and scratch-resistant, crosslinked, polymeric layer upon radiation curing, said coating composition consisting essentially of (a) either (i) a mixture of a siloxy-containing polycarbinol and an acrylated urethane or (ii) a siloxy-containing acrylated urethane, (b) a multifunctional acrylate of the formula:

$$(\overset{\overset{\displaystyle Y^1}{|}}{C}H=\overset{\overset{\displaystyle Y^2}{|}}{C}-\overset{\overset{\displaystyle O}{\|}}{C}-O)_p Y^3-Y^4$$

wherein p is an integer from 1 to 3; $Y^1$ and $Y^2$ are independently hydrogen, halo or alkyl; $Y^3$ is a polyvalent aliphatic, alicyclic or aromatic group; and $Y^4$ is hydrogen or $$-O-\overset{\overset{\displaystyle O}{\|}}{C}-\overset{\overset{\displaystyle Y^2}{|}}{C}=\overset{\overset{\displaystyle Y^1}{|}}{C}H,$$

provided that when p is 1, $Y^4$ is $$-O-\overset{\overset{\displaystyle O}{\|}}{C}-\overset{\overset{\displaystyle Y^2}{|}}{C}=\overset{\overset{\displaystyle Y^1}{|}}{C}H;$$

and (c) a free radical photoinitiator; and (5) subjecting said coating to radiation sufficient to cure said coating and to bond it to said photoconductive layer.

* * * * *